US006931690B2

(12) United States Patent
Cox

(10) Patent No.: US 6,931,690 B2
(45) Date of Patent: Aug. 23, 2005

(54) SPRING-BIASED PIVOTING SQUEEGEE

(76) Inventor: Grant Cox, 1600 Courtyards East, Windsor, CA (US) 95492

( * ) Notice: Subject to any disclaimer, the term of this patent is extended or adjusted under 35 U.S.C. 154(b) by 8 days.

(21) Appl. No.: 10/439,852

(22) Filed: May 15, 2003

(65) Prior Publication Data

US 2004/0226125 A1 Nov. 18, 2004

(51) Int. Cl.[7] ..... A47L 1/06
(52) U.S. Cl. ..... 15/245; 15/144.1; 15/245.1
(58) Field of Search ..... 15/245, 143.1, 15/145, 144.1, 117, 121, 236.01, 245.1; 16/430; 30/329, 335, 336, 337, 338, 330, 331, 169

(56) References Cited

U.S. PATENT DOCUMENTS

| | | | | | |
|---|---|---|---|---|---|
| 731,338 | A | * | 6/1903 | Cattelle | 15/245 |
| 742,590 | A | | 10/1903 | Catelle | |
| 2,440,099 | A | * | 4/1948 | Kind | 15/245 |
| 3,892,005 | A | * | 7/1975 | Berns | 15/245 |
| 4,124,915 | A | * | 11/1978 | Schlicher | 15/105 |
| 4,336,624 | A | * | 6/1982 | Pichelman et al. | 15/245 |
| 4,697,296 | A | * | 10/1987 | Smahlik | 15/245 |
| 4,777,694 | A | * | 10/1988 | Young | 15/245 |
| 4,847,938 | A | * | 7/1989 | Unger | 15/245 |
| 4,941,228 | A | * | 7/1990 | Belanger et al. | 15/245 |
| 4,993,101 | A | * | 2/1991 | Newman, Sr. et al. | 15/245 |
| 5,175,902 | A | | 1/1993 | Samuelsson | |
| 5,369,841 | A | * | 12/1994 | Bembnowski | 16/278 |
| 5,930,863 | A | * | 8/1999 | Samuelsson | 15/245 |
| 6,298,516 | B1 | * | 10/2001 | Beals et al. | 15/143.1 |
| 6,601,272 | B2 | * | 8/2003 | Stvartak et al. | 16/430 |

* cited by examiner

*Primary Examiner*—Gary K. Graham
(74) *Attorney, Agent, or Firm*—Brian Beverly

(57) ABSTRACT

A spring-biased pivoting squeegee 10 provides a head 12 pivotally attached to a handle 16. The head 12 is movable between a rest position, in which the head 12 is angularly displaced from the handle 16, and a biased position in which the head 12, handle 16, and wiping blade 14 are in linear relation. In the biased position, the wiping blade is maintained at an optimum angle for cleaning a glass surface even with the handle 16 held generally perpendicular to the glass. A spring 60 is fully contained in the head 12 and biases the head toward the rest position. A tension adjustment knob 80 in the head 12 permits adjustment of the spring 60 to a tension level according to the ergonomic requirements of a user.

18 Claims, 7 Drawing Sheets

SPRING-BIASED PIVOTING SQUEEGEE

FIELD OF THE INVENTION

This invention relates generally to squeegees and in particular to a squeegee having a head, handle and wiping blade which can be moved into general linear relation for cleaning glass surfaces, even surfaces located in recessed corners.

DESCRIPTION OF THE PRIOR ART

Squeegees are widely used to clean windows quickly and effectively. Generally the cleaning process begins with wetting the window surface with water or a cleaning solution. The squeegee is then used to wipe off the water or cleaning solution and any accumulated dirt or dust leaving the window surface clean. When performed expertly, a movement sometimes known as the "butterfly stroke" is used in which the squeegee's wiping blade is initially placed along the edge of one corner of the window; then the entire surface of the window is wiped off in a continuous back-and-forth swirling motion from the top to the bottom of the window without removing the wiping blade from the surface, finishing the motion by drawing the blade to the edge of another corner. With practice, this motion can be performed with considerable efficiency. When numerous windows are to be cleaned at one time, such as all the windows in a large office building or, increasingly, in many residential applications, proficient cleaning of each window becomes important.

With long experience it has been found that the wiping blade will most effectively wipe a surface clean if it is maintained within a relatively narrow range of acute angles relative to the surface. Failure to swipe the surface at an optimal angle within that range will lead to streaking and visibly unsatisfactory results. In order to comfortably handle the squeegee and maintain the wiping blade at an optimal angle, squeegees are typically constructed with the blade mounted at an angle relative to the handle of the squeegee, as indicated in U.S. Pat. No. 2,123,638, issued to Ettore Steccone in 1938. More precisely, the blade is mounted on a head which is generally in planar alignment with the blade, and the head is angularly displaced relative to the handle. However, this conventional construction creates a problem when cleaning recessed windows.

A common architectural feature calls for windows to be recessed into a window frame or to be set immediately adjacent to a perpendicular wall. If the window is recessed more than a few inches, or set next to a wall, wiping off the entire window in a continuous stroke as described above may not be possible, because the handle will butt against the adjacent window frame or wall. When this happens, the conventional practice is to wipe the small section of window clean with a cloth. Alternatively, the window cleaner may remove the squeegee from the window, wipe the blade clean, reposition the squeegee so that the blade may be applied again to the window edge adjacent the frame or wall, and then finish wiping the window clean with a second stroke. Either alternative is less efficient than wiping a window clean in a single continuous motion and may produce streaking.

A variation of the problem arises when cleaning windows using a squeegee mounted on a pole. Poles are used whenever the height of the window is great enough that it cannot be reached easily without a pole. Typically cleaning a tall window with a squeegee mounted on a pole involves performing several vertical strokes starting from the top of the window moving down to the bottom. If the bottom of the window is near ground level, the angle of the squeegee to the handle makes it impossible to hold the wiping blade at an optimal cleaning angle relative to the window surface. Therefore, the squeegee must be removed from the window and the window cleaner must move to a new position which permits the squeegee to be reapplied at a proper angle to the window, or the bottom of the window must be finished with close-up work using a hand-held squeegee.

One attempt to solve this problem is described in U.S. Pat. No. 5,175,902 to Samuelsson, which discloses a squeegee device including a squeegee blade mount which is pivotally attached to and disposed between the distal ends of a pair of laterally spaced apart fingers extending from a distal end of a fitting. A handle is attached to the other end of the fitting. A U-shaped kicker arm is carried on the back side of the mount. A squeegee blade is held on the front side of the mount. The mount is biased to a normal position by a pair of springs extending between the kicker arm and the pair of fingers. When the squeegee blade is drawn along the surface of a window, as it approaches an abutting wall, window frame or window ledge, the kicker arm engages the abutment and orbits the mount, consequently driving the blade through an arc relative to the handle and thereby accelerating movement of the wiper blade to complete the stroke in the direction of the abutment. Samuelsson reorients the wiper blade with respect to the handle, but this device appears to be workable only on windows that are not deeply recessed. This device also changes the orientation of the blade to the handle, which may cause an undesirable reduction in the cleaning effectiveness of the squeegee blade as it passes through the accelerating movement. Another practical difficulty is that the kicker arm, mount, and dual fingers project from the otherwise generally contained outline of the squeegee and may interfere with or become tangled up in other equipment. Finally, the device is not contained within the body of a standard squeegee; it is a separate device that must be specially mounted to the head of a squeegee and adds another item to the inventory of equipment that a window washer must carry.

SUMMARY OF THE INVENTION

A spring-biased pivoting squeegee provides a wiping blade transversely mounted on the forward portion of the head of a squeegee. A handle is pivotally attached to a back portion of the head about a pivot pin which forms an axis parallel to the wiping blade. The head is movable relative to the handle about the pivot pin between a rest position and a biased position. In the rest position the head is angularly displaced relative to the handle at an angle which positions the head and wiping blade at an angle conventionally found in prior art squeegees. In the biased position the head is in linear disposition with the handle thus positioning the wiping blade, head, and handle in general planar relation.

A spring having dual coils, both of which are looped around the pivot pin which joins the handle and head, is fully contained inside the head of the squeegee. Rearward projections of the spring are biased against an internal wall of the handle, and a U-shaped projection extending forward from the pivot pin into the head biases the head toward the rest position. The spring is set at a tension such that, under normal usage, the head and, hence, the wiping blade, are maintained at an angle relative to the handle; however, the tension is low enough such that, without ever removing the blade from contact with the glass surface, the head and wiping blade may be moved to the biased position by pressing down on the handle. The handle and head are prevented from over-pivoting beyond planar configuration by abutting surfaces which are brought into mutual contact when the head is moved into the biased position.

A recessed locking lever is pivotally attached to the squeegee head. The locking lever is movable about an axis generally perpendicular to the squeegee head between a locking position and an unlocked position. In the locking position, the lever is in abutting disposition with a stop on the handle. Pressure from the spring urges the lever and stop together, effectively locking the head and handle in the biased position. The pressure may be relieved by bringing slight backwards pressure against the head whereupon the lever may be rotated into the unlocked position where it is free of any obstructions, thus permitting the head to pivot back to the rest position.

A tension adjustment mechanism permits the spring tension to be adjusted to different pressure levels. A tension adjustment knob is provided on the upper surface of the squeegee head. The tension adjustment knob has a barrel fitting which sits in a well in the head to retain a knurled top portion above the upper surface of the head for manipulation by hand. A linear projection extends from the barrel fitting into the head and is in threaded engagement with a square tension adjustment nut disposed in a rectangular internal shaft in the head. As the knob is turned the nut is prevented from rotating by the walls of the rectangular shaft. Therefore, rotation of the knob moves the nut up and down in the shaft. The U-shaped projection of the spring is disposed around the linear projection and interposed between the tension adjustment knob and the tension adjustment nut. Thus, by rotating the tension adjustment knob, the U-shaped projection of the spring is lowered or raised in the head by the tension adjustment nut which adjusts the spring to a tension level suited to the ergonomic requirements of the user.

A spring-biased pivoting squeegee according to the invention can be used in the same manner as a prior art squeegee would be used in most situations. Improved performance is realized when cleaning recessed windows. As the squeegee is drawn across the window toward an abutting wall or window frame, the window washer may cause the head to move into the biased position by simultaneously pressing down on the wiping blade and forward on the handle, never removing the wiping blade from the surface of the glass. Since the wiping blade, head, and handle are all in planar disposition, the wiping motion can be continued toward the abutting wall or frame member to the edge of the glass, rather than having to remove the wiping blade from and then reapply it to the glass. Thus, an entire recessed window may be cleaned in a single continuous motion with a high degree of proficiency, leading to substantial time savings in the cleaning project, eliminating the need to use additional cleaning implements, and reducing fatigue.

An added benefit of the invention relates to the angle of the wiping blade to the glass. By maintaining the wiping blade of a squeegee at a slight angle to the perpendicular relative to the glass, the cleaning performance of the blade is superior. Therefore, the best squeegees include a slight curvature in the wiping blade mount which maintains the blade at an optimum cleaning angle. Generally, when cleaning a glass surface with a squeegee, an effort is made to hold the squeegee so that the wiping blade is retained at the optimum cleaning angle. The present invention enables the optimum cleaning angle to be retained as the squeegee is moved toward the abutting wall or frame of a recessed window, because the angle of the squeegee head to the window can be maintained by easily altering the angle of the head to the handle. The ease in adjusting the angle allows improved performance through a range of positions and provides ergonomic benefits to the user. Even at the extreme edge of a recessed window or in difficult to reach positions, the invention preserves the optimum cleaning angle and the safety of the window washer.

BRIEF DESCRIPTION OF THE ILLUSTRATIONS

DETAILED DESCRIPTION OF THE ILLUSTRATED EMBODIMENT

Figure 1B:
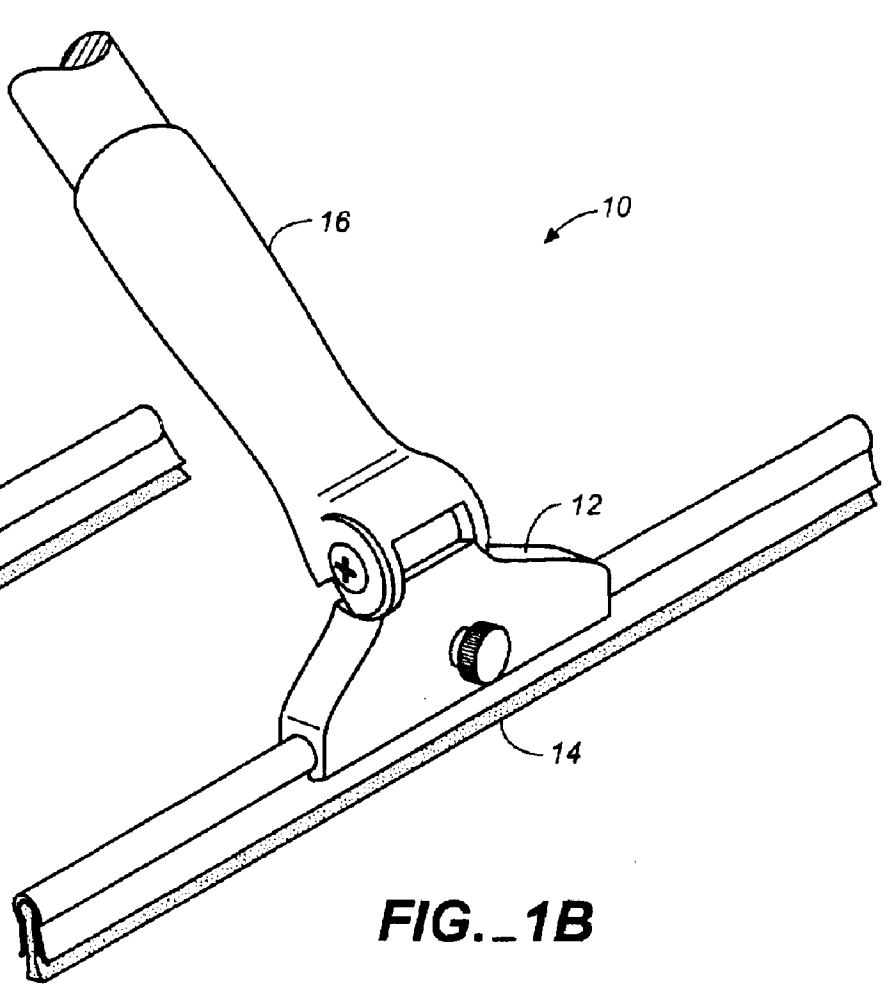
FIG. 1B is a top perspective view of the pivoting squeegee of FIG. 1A, but showing the head in the rest position relative to the handle.

A spring-biased pivoting squeegee 10 is now described in relation to the illustrations according to the invention. A spring-biased pivoting squeegee 10 comprises a head 12 to which is mounted a wiping blade 14 and a handle 16. The head 12 has a generally planar geometry, a back portion 18, and a forward portion 20. The wiping blade 14 is mounted on the forward portion 20 generally transversely to the head. The wiping blade has a forward edge portion 15.

Figure 1A:
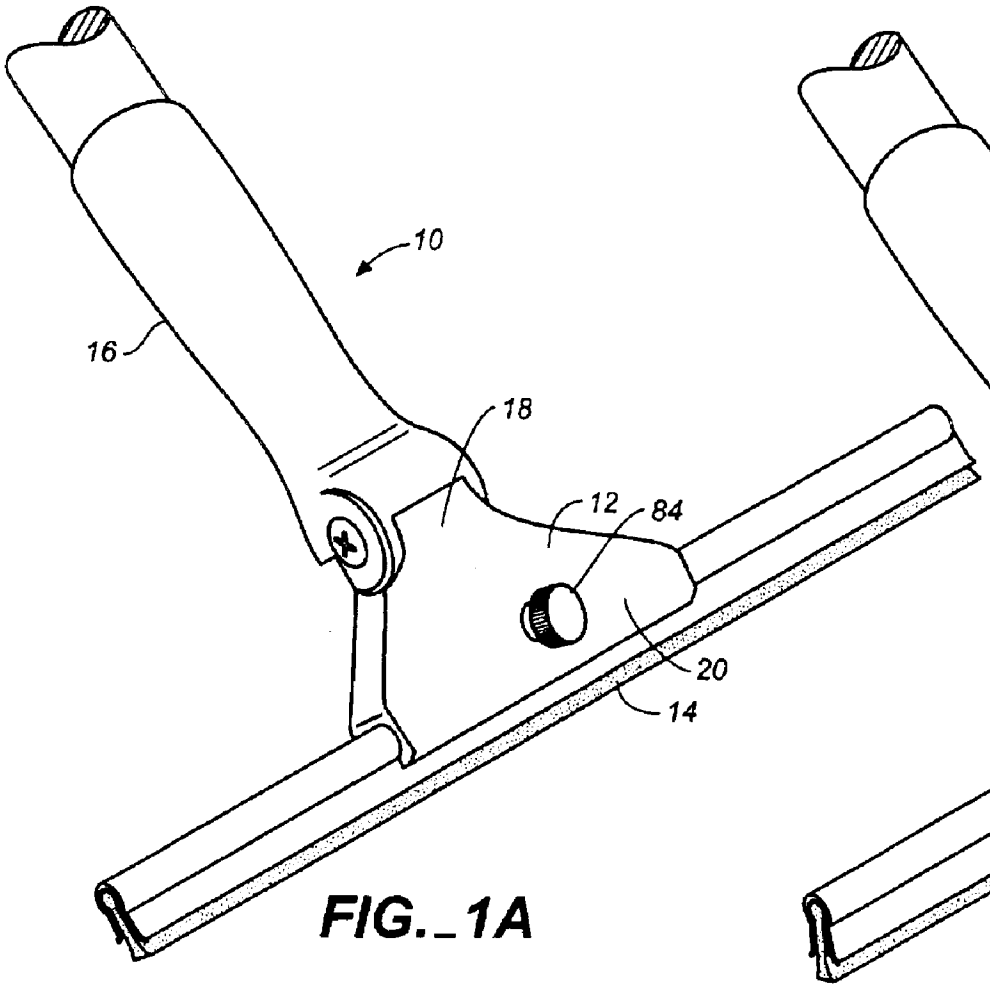
FIG. 1A is a top perspective view of a spring-biased pivoting squeegee according to the invention showing the head in the biased position relative to the handle.
Figure 2B:
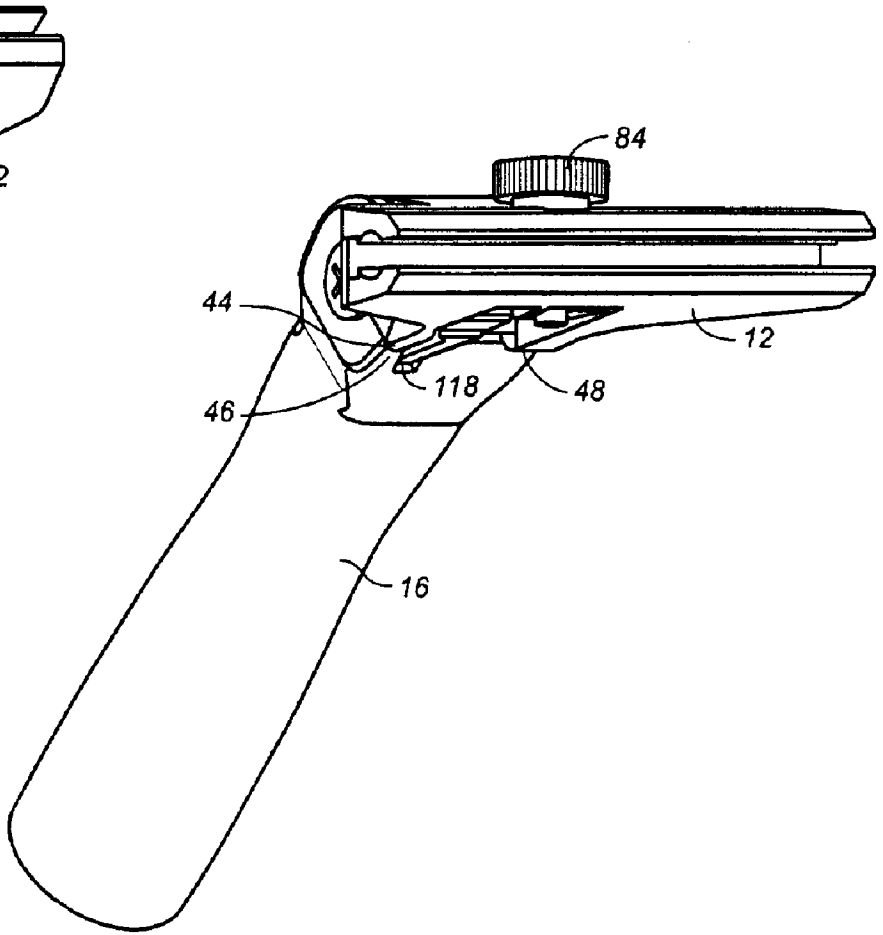
FIG. 2B is a bottom perspective view of the pivoting squeegee shown in FIG. 2A, but with the head in the rest position relative to the handle.
Figure 2A:
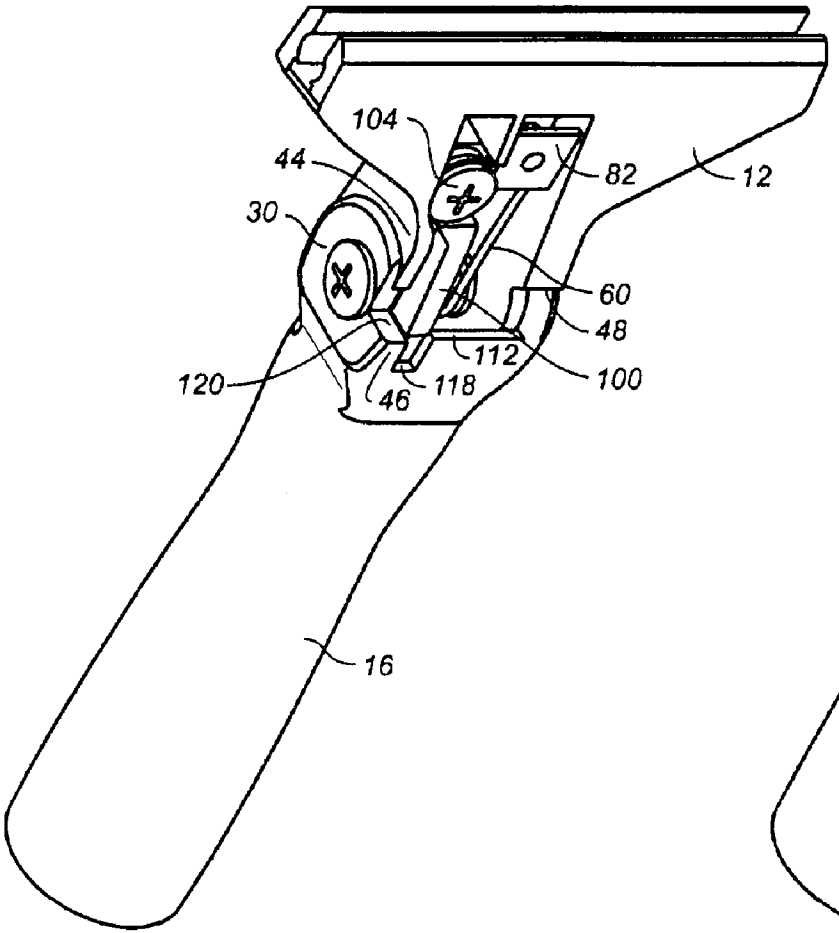
FIG. 2A is a bottom perspective view of the invention with the wiping blade removed, and showing the head in the biased position relative to the handle and the locking lever in the unlocked position.
Figure 2C:
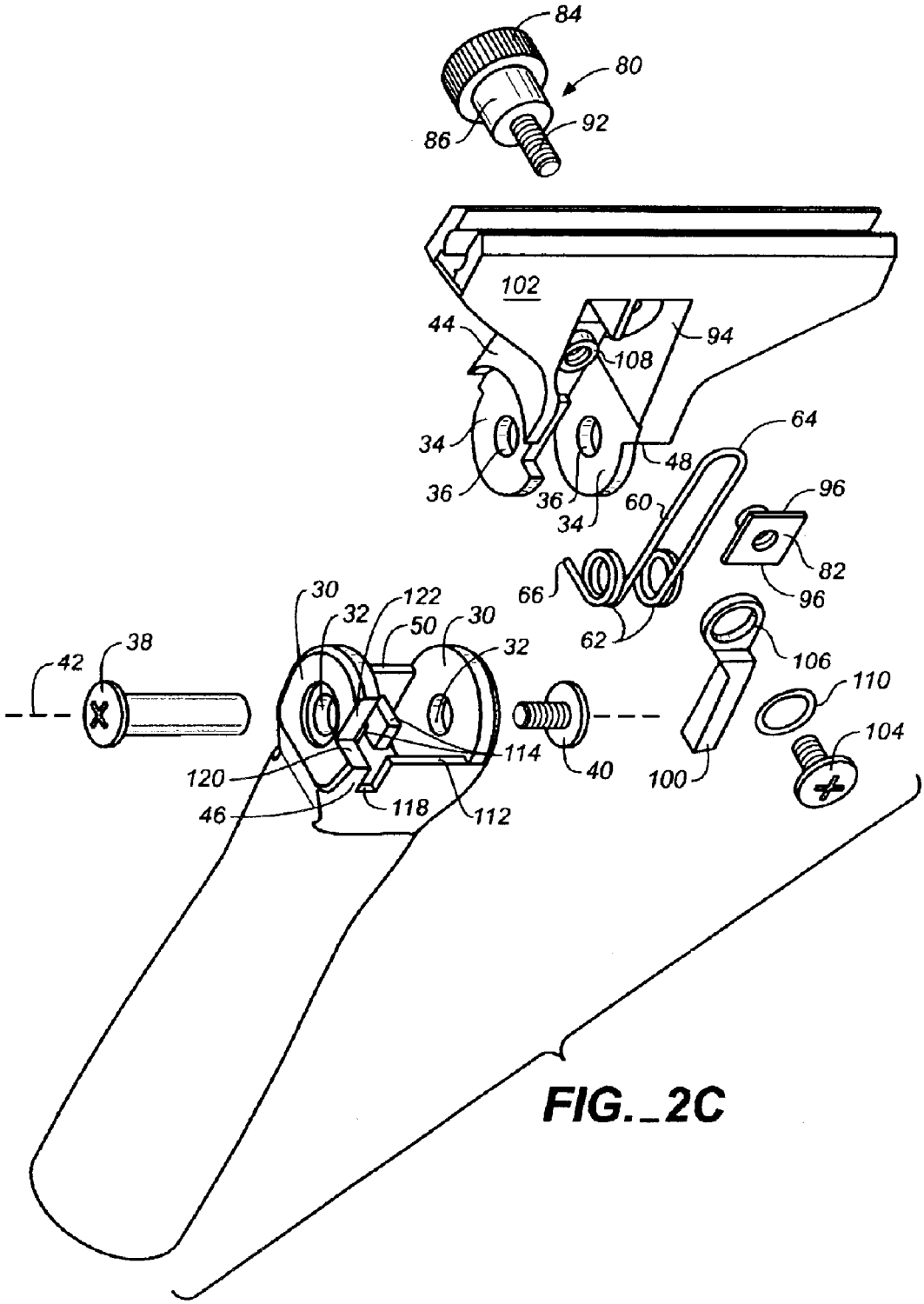
FIG. 2C is an exploded perspective view of a spring-biased pivoting squeegee according to the invention.

The front part of the handle 16 is provided with generally hemispherical forward projecting outer plates 30 each having a center aperture 32, best seen in FIG. 2C. The back portion of the head is provided with generally hemispherical rear projecting inner plates 34 disposed generally perpendicular to the head, each having a center opening 36. When the invention is fully assembled, the inner plates 34 on the head 12 fit cooperatively within and in concentric alignment with the outer plates 30 of the handle such that the center apertures 32 and center openings 36 are in axial alignment. A barrel nut 38 and screw 40, when assembled and inserted in the center apertures 32 and center openings 36, form a hinge for pivotal attachment of the handle 16 and head 12 around an axis 42 which is parallel to the wiping blade. So assembled, the forward edge portion 15 of the wiping blade 14 is disposed in planar alignment with axis 42. See FIGS. 1A and 6A.

Figure 3A:
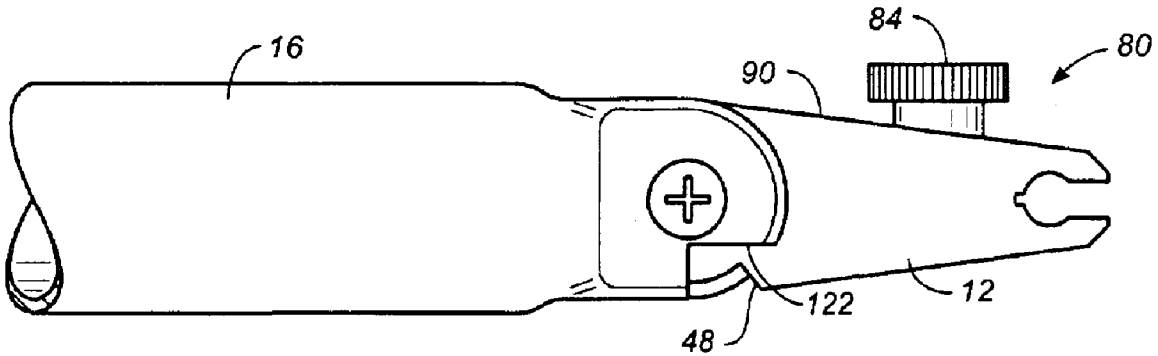
FIG. 3A is a side plan view of a pivoting squeegee according to the invention with the handle truncated, and showing the head in the biased position relative to the handle.
Figure 3B:
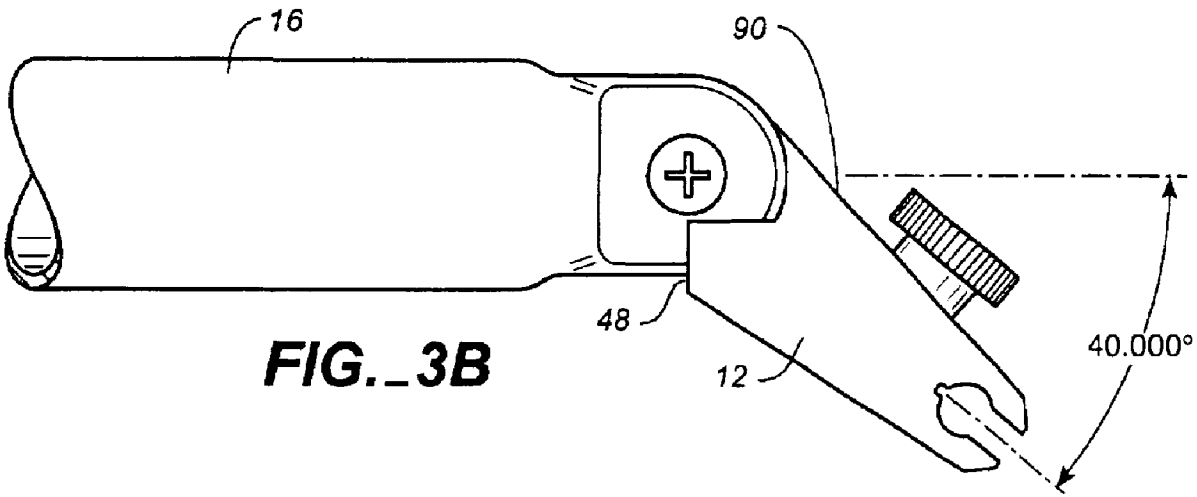
FIG. 3B is a side plan view of the pivoting squeegee of FIG. 3A, showing the head in the rest position relative to the handle.
Figure 4A:
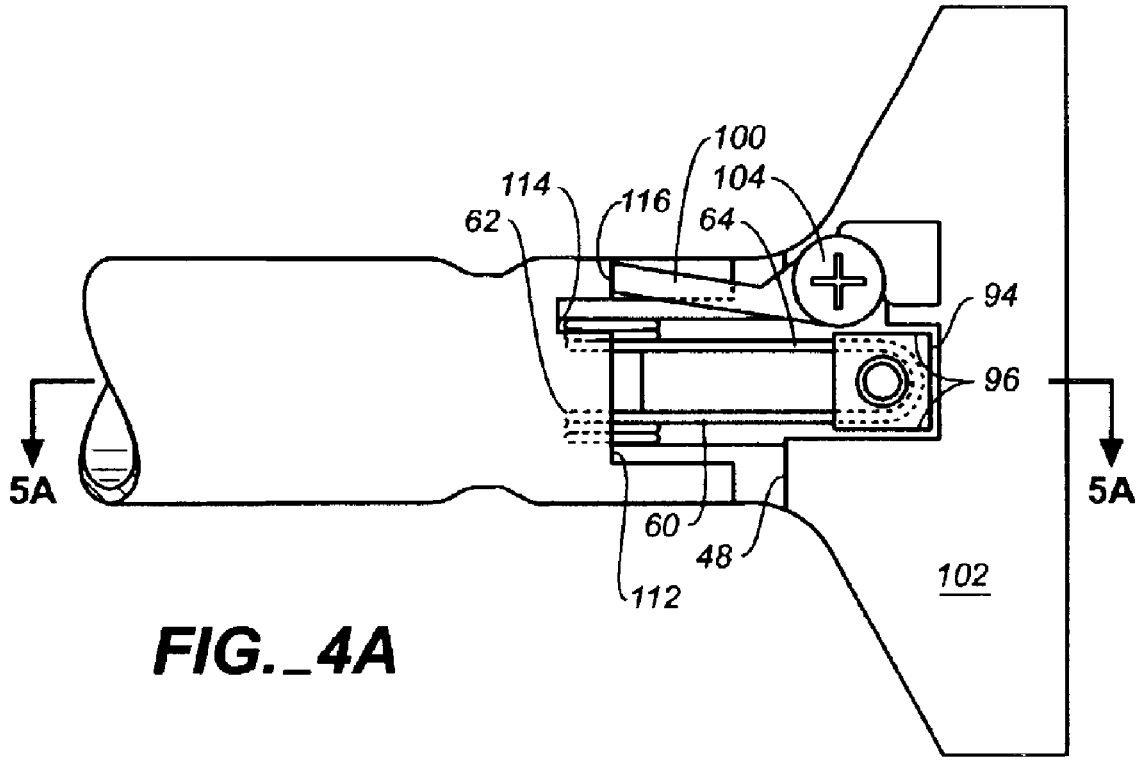
FIG. 4A is a bottom plan view of the invention with the handle truncated and showing the locking lever in the locked position.
Figure 4B:
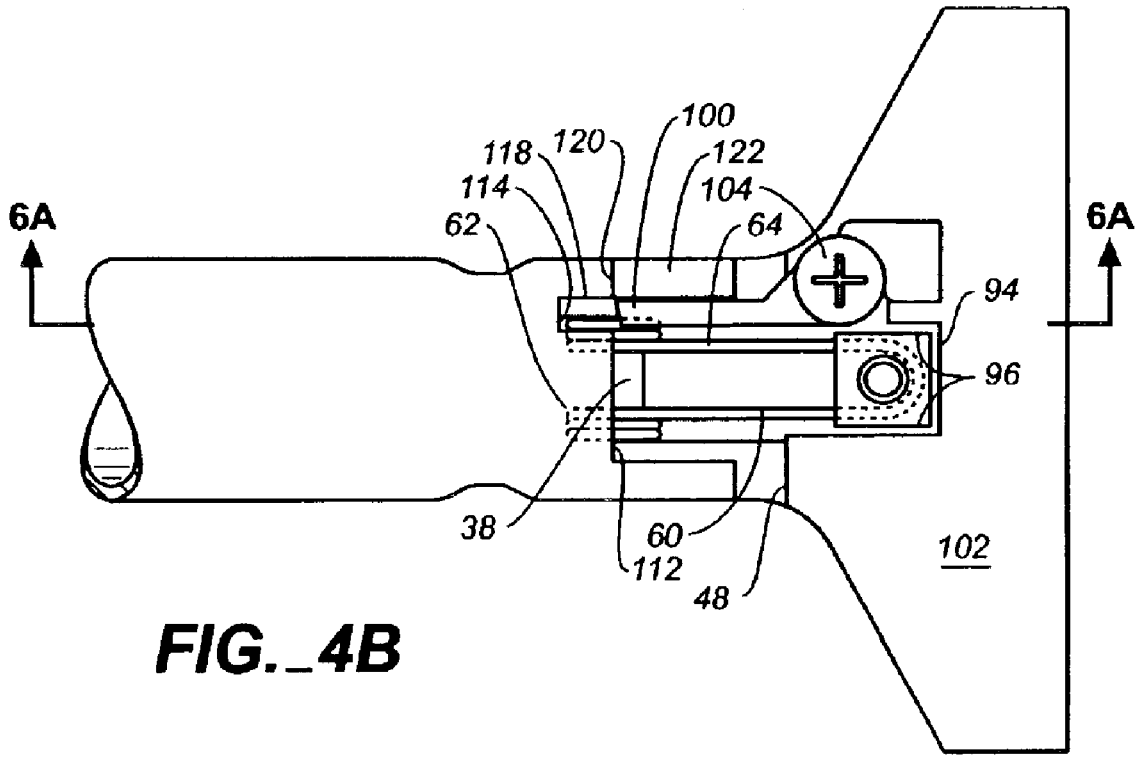
FIG. 4B is a bottom plan view of the invention shown in FIG. 4A, but with the locking lever shown in the unlocked position.

The pivoting head 12 of the squeegee is movable about the axis 42 between a rest position and a biased position in relation to the handle 16, as seen in FIGS. 3B and 3A, respectively. The rest position displaces the head 12, and thus the wiping blade 14, at an angle relative to the handle so that the wiping blade 14 may easily be held at an optimum angle to the glass for cleaning effectiveness. In the art the optimum angle is generally known to be about forty degrees, but this could vary by perhaps ten degrees. In the rest position, the head 12 is prevented from over-pivoting to a greater angle by abutment of collar 44 with the bottom edge 46 of one of the outer plates 30 on the handle 16 as shown in FIGS. 2A and 2B and by direct abutment of face 48 with shelf 112, as best seen by referring to FIGS. 2A, 2C, 5A, and 5B. Pivoting the head to the biased position seen in FIG. 3A positions the head in linear alignment with the handle, thus putting the wiping blade, head, and handle in overall planar alignment. The head 12 is prevented from over-pivoting beyond linear relation with the handle by juxtaposition of abutting wall 50 on the handle and the rear edge 52 of the top of the head 12, as shown in FIGS. 6A and 6B.

Reference to FIGS. 2A, 2C, 4A, 4B, 5A, and 5B show spring 60 fully contained inside the head 12 of the squeegee and biased toward the rest position. The spring 60 preferably comprises dual coils 62 which are looped around barrel nut 38 effectively capturing the spring at the axis of rotation 42. A U-shaped projection 64 extends forward from coils 62 into head 12. Rearward projections 66 extend up generally perpendicular to the U-shaped projection 64 and are held in tension against and in close proximity to dual backstops 68 of handle 16. Preferably each backstop 68 has a concave forward face 70 against which projections 66 are seated to restrict lateral movement. The U-shaped forward projection 64 is held in place in the head 12 by a tension adjustment mechanism described below.

Figure 5A:
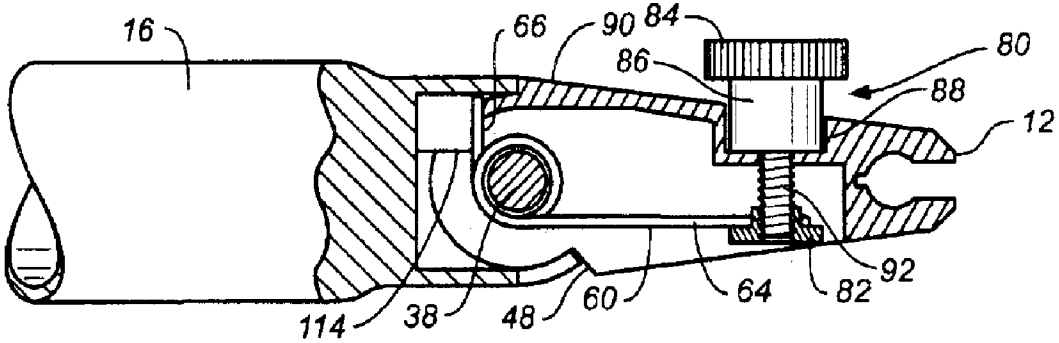
FIG. 5A is a side elevation view of a pivoting squeegee according to the invention, cutaway through the middle of the head to show the spring and tension adjustment mechanism and showing the head in the biased position relative to the handle.
Figure 5B:
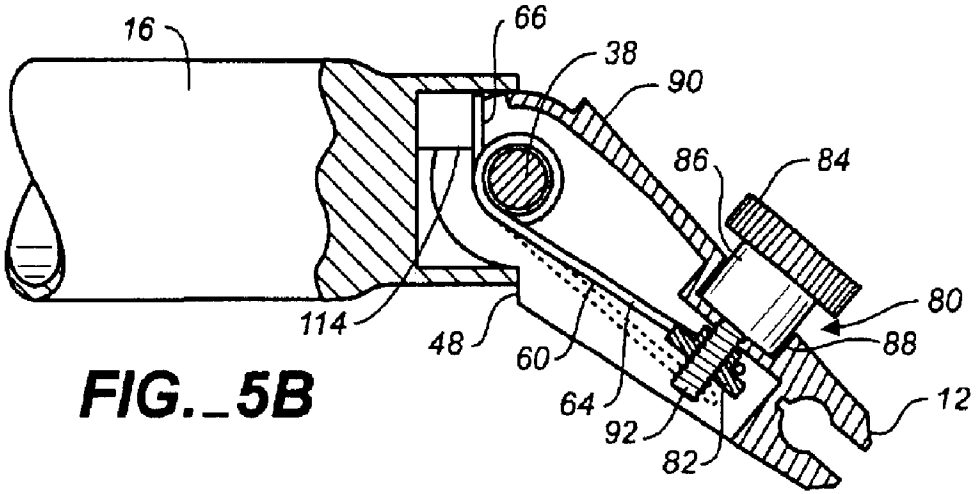
FIG. 5B is a side elevation view of the invention similar to that shown in FIG. 5A, but showing the head in the rest position relative to the handle.
Figure 6A:
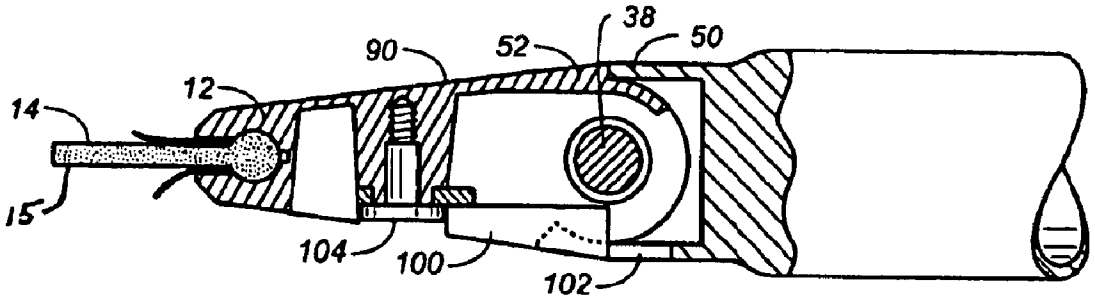
FIG. 6A is a side elevation view of the invention showing the head cutaway off-center to show the locking lever in the locked position and showing the head in the biased position relative to the handle.
Figure 6B:
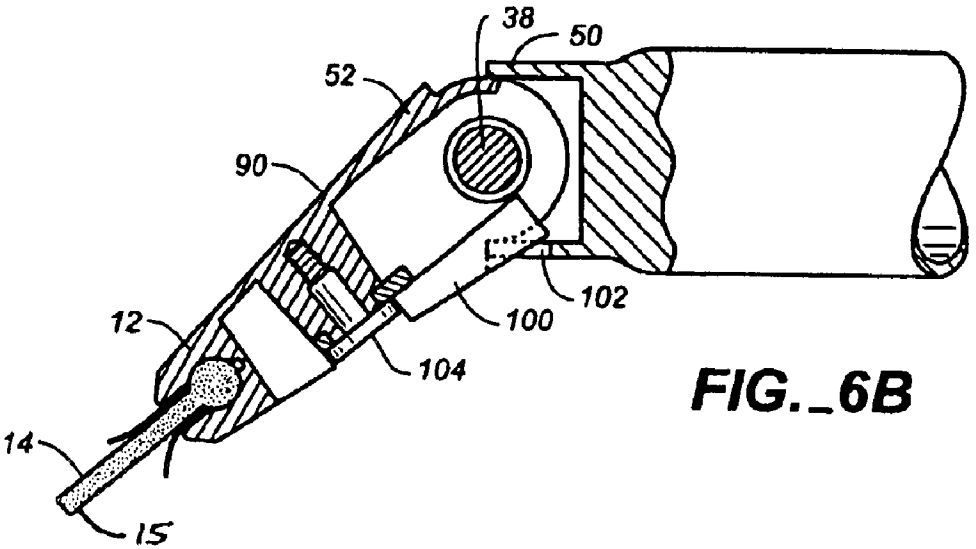
FIG. 6B is a side elevation view of the invention similar to that shown in FIG. 6A, but showing the locking lever in the unlocked position and showing the head in the rest position relative to the handle.

Referring to FIGS. 2C, 5A and 5B, it is seen that the tension adjustment mechanism comprises a tension adjustment knob 80 and tension adjustment nut 82. The tension adjustment knob 80 has a knurled top 84 to facilitate turning of the knob. A barrel fitting 86 extends from the knurled top 84 and is seated in recess 88 in the top surface 90 of head 12. The recess 88 is set at a depth appropriate to capture it in the head 12 against lateral movement, but sufficiently shallow that the knurled top 84 is retained at an accessible level above the top surface 90 of the head 12. A linear projection 92 extends from the barrel fitting 86 through head 12 and is in threaded engagement with the tension adjustment nut 82. The U-shaped projection 64 of the spring 60 passes around the linear projection 92 between the tension adjustment knob 80 and the tension adjustment nut 82 and is biased toward the tension adjustment nut 82 so that the tension adjustment knob 80 is retained in place in the head 12. The tension adjustment nut 82 is freely disposed in a rectangularly shaped internal shaft 94 in the head 12 with the squared edges 96 of the nut 82 in sufficient proximity to the walls of shaft 94 that, when the tension adjustment knob 80 is turned, nut 82 is prevented from turning but travels longitudinally in shaft 94. Accordingly, as shown by the shaded lines in FIG. 5B, as nut 82 is moved up or down by clockwise or counter-clockwise rotation of knob 80, the U-shaped projection 64 of the spring 60 moves up or down within head 12 to adjust the tension of the spring to a level appropriate to working conditions. Thus the invention provides a squeegee having the head 12 angularly displaced from the handle 16 in a rest position and held in the rest position by spring tension. The head is movable to a biased position by pressure bearing against the spring when needed. The head pivots back to the rest position when the pressure is released.

Although the preferred embodiment of the invention provides for the dual coiled spring 60 described above, alternative embodiments of the invention could provide a single coil spring or a plurality of coiled springs. In other embodiments, leaf or helical springs could be adapted to use.

Referring now to FIGS. 2C, 4A, 6A and 6B, a locking lever 100 is attached to head 12 but is recessed such that the lever 100 is generally flush with the lower surface 102 of the head. Screw 104 is threaded through retention ring 106 of lever 100 into aperture 108 in head 12 for pivoting movement of the lever 100 about an axis perpendicular to head 12. Wave washer 110 is provided between the head of screw 104 and ring 106 so that, when screw 104 is backed off slightly from a fully tightened configuration, lever 100 is rotatable between a locking position and an unlocked position, but is held in limited tension sufficient to retain the lever 100 in the last position to which it was moved. When the head 12 is moved into the biased position relative to the handle 16, the locking lever 100 can be moved into the locking position seen best in 4A. In the locking position the rear face 116 of the locking lever 100 is in abutment with the forward-facing surface 120 of cutout 122 in outer plate 30. The rear face 116 and forward-facing surface 120 are in compressed abutment resulting from the bias of the head 12 toward the rest position. The locking lever 100 is retained in place by head-to-head abutment with forward-facing surface 120 and lateral abutment with collar 44. However, with slight back pressure on head 12, the lever 100 can be pivoted from the locking position to the unlocked position shown in FIG. 4B. A notch 118 is provided in handle 16 through which the lever passes as head 12 pivots to the rest position shown in FIG. 6B.

In normal operation and in most circumstances the invention should be used like a conventional squeegee. After wetting the window surface with water or a cleaning solution, the squeegee is applied to the surface at an edge of the window generally with one end of the squeegee blade disposed in a corner of the window. The squeegee's wiping blade is then swept across all parts of the window surface where an optimal cleaning angle can be sustained with the head in the rest position. However, when cleaning recessed windows, as the squeegee blade is being drawn to a corner or edge adjacent an abutting wall, deep window frame or window ledge, forward pressure on the handle combined with continuing downward pressure on the wiping blade will pivot the head of the squeegee from the rest position into the biased position. When the head is in the biased position, the wiping blade of the squeegee can be maintained at an optimum cleaning angle to the glass surface even if the handle, head, and wiping blade are all in linear disposition and the handle is perpendicular to the window. Therefore, recessed windows can be wiped clean with the invention in a single continuous stroke rather than by the inefficient methods of removing the squeegee from the window and starting a new stroke or by hand wiping the remaining uncleaned portion of the window. In situations where windows reachable only with poles are also recessed, the invention eliminates the need to retract the pole, wipe the blade, then re-extend the pole for a second stroke. Similarly, when tall ground level windows are being cleaned using pole-mounted squeegees, the locking lever may set the head in the biased position such that the squeegee may be drawn down the entire height of the window to ground level in a single stroke while retaining the wiping blade at an optimal angle to the window surface.

There have thus been described and illustrated certain preferred embodiments of a spring-biased pivoting squeegee according to the invention. Although the present invention has been described and illustrated in detail, it is clearly understood that the same is by way of illustration and example only and is not to be taken by way of limitation, the spirit and scope of the present invention being limited only by the terms of the appended claims and their legal equivalents.

What is claimed is:

1. A squeegee comprising:

a head having a general planar geometry and a forward portion, a wiping blade mounted on said forward portion, said blade having a planar forward edge portion, a handle pivotally attached to said head about an axis parallel with said wiping blade, said forward edge portion of said blade disposed in planar alignment with said axis, said head movable about said axis between a rest position and a biased position, said head in said rest position angularly displaced relative to said handle, and in said biased position said head, said blade and said handle in general planar relation, and a spring extending from said axis for urging said head towards said rest position.

2. The squeegee of claim 1 wherein:

said wiping blade is mounted on said forward portion transversely to said head.

3. The squeegee of claim 1 wherein:

in said biased position said head is generally disposed in linear relation with said handle.

4. The squeegee of claim 1 wherein:

said wiping blade extends radially from and forward of said axis.

5. The squeegee of claim 4 wherein:

said wiping blade is spaced from said axis.

6. The squeegee of claim 1 wherein:

said spring is generally contained within said head.

7. The squeegee of claim 1 wherein:

when said head is located in said biased position, said wiping blade, said head and said handle are generally in planar alignment.

8. The squeegee of claim 1 further comprising:

means for limiting angular displacement of said head in said biased position relative to said handle to a position in which said head, said wiping blade and said handle are in general planar relation.

9. The squeegee of claim 1 wherein:

in said rest position said head has an angular displacement relative to said handle of about thirty-five degrees.

10. A squeegee comprising:

a head having a forward portion, a lower surface and a cavity in said lower surface, a wiping blade mounted on said forward portion, a handle having a forward-facing surface, said handle pivotally attached to said head about an axis parallel with said wiping blade, said head movable about said axis between a rest position and a biased position, said head in said rest position angularly displaced relative to said handle, and said head in said biased position disposed in general planar relation with said handle, and a spring extending from said axis for urging said head towards said rest position, and a lever embedded in said cavity, said lever having a bottom edge in generally flush disposition with said lower surface of said head, said lever pivotally attached to said head about an axis generally perpendicular to said head, said lever movable between a locking position and an unlocked position, in said locking position said lever in compressed abutment with said forward-facing surface for holding said head in said biased position against pressure bearing transversely on said head, and in said unlocked position, said lever angularly displaced from said locking position and disengaged from said forward-facing surface.

11. A squeegee comprising:

a head having a forward portion, a wiping blade mounted on said forward portion, a handle pivotally attached to said head about an axis parallel with said wiping blade, said head movable about said axis between a rest position and a biased position, said head in said rest position angularly displaced relative to said handle, and said head in said biased position disposed in general planar relation with said handle, a spring having at least two coils and a U-shaped forward projection extending from said axis, said spring for urging said head towards said rest position, said spring having at least one rearward projection extending from said at least one coil, said rearward projection generally perpendicular to said U-shaped projection, said rearward projection lodged against said handle, and a pivot pin disposed in said at least two coils, said handle pivotally attached at said axis to said head about said pivot pin.

12. A squeegee comprising:

a head having a forward portion, a wiping blade mounted on said forward portion, a handle pivotally attached to said head about an axis parallel with said wiping blade, said head movable about said axis between a rest position and a biased position, said head in said rest position angularly displaced relative to said handle, and said head in said biased position disposed in general planar relation with said handle, a spring extending from said axis for urging said head towards said rest position, and means for adjusting the tension of said spring.

13. The squeegee of claim 12 wherein:

said head has a generally planar geometry and includes a transversely extending internal shaft, said shaft having at least two opposed walls in generally parallel relation, said spring has a U-shaped forward projection extending from said axis, and said means for adjusting comprises a tension adjustment knob rotatably disposed on said head, a linear projection extending from said tension adjustment knob into said internal shaft, and a tension adjustment nut freely disposed in said shaft and in threaded engagement with said linear projection, said tension adjustment nut having at least two generally parallel opposite edges disposed in sufficient proximity to said opposed walls of said shaft that said nut is prevented from rotating, and said U-shaped projection of said spring is interposed between said tension adjustment knob and said tension adjustment nut and biased against said tension adjustment nut, such that rotation of said tension adjustment knob rotates said linear projection and varies the distance between said tension adjustment knob and said tension adjustment nut for adjusting the tension of said spring.

14. A squeegee comprising:

a head having a general planar geometry and a forward portion, a wiping blade mounted on said forward portion transversely to said head, said blade having a planar forward edge portion, a handle pivotally attached to said head about an axis parallel with said wiping blade, said wiping blade extending radially from and forward of said axis, said forward edge portion of said blade disposed in planar alignment with said axis, said head movable about said axis between a rest position and a biased position, said head in said rest position angularly displaced relative to said handle, and in said biased position said head, said wiping blade and said handle in general planar relation, and a spring generally contained within said head, said spring having a forward projection extending from said axis for urging said head towards said rest position.

15. The squeegee of claim 14, further comprising:

a pivot pin, said handle pivotally attached at said axis to said head about said pivot pin, wherein said spring has at least one coil, said pivot pin is disposed in said at least one coil.

16. A squeegee comprising:

a head having a forward portion, a lower surface and a recess in said lower surface, a wiping blade mounted on said forward portion transversely to said head, a handle having a forward-facing surface, said handle pivotally attached to said head about an axis parallel with said wiping blade, said wiping blade extending radially from and forward of said axis, said head movable about said axis between a rest position and a biased position, said head in said rest position angularly displaced relative to said handle, and with said head in said biased position said wiping blade, said head and said handle are generally disposed in linear relation, a lever pivotally attached to said head in said recess about an axis perpendicular to said head, said lever having a bottom edge in generally flush disposition with said lower surface of said head, said lever movable between a locking position and an unlocked position, in said locking position said lever in compressed abutment with said forward-facing surface for holding said head in said biased position, and in said unlocked position said lever angularly displaced from said locking position and disengaged from said forward-facing surface, and a spring generally contained within said head, said spring having a forward projection extending from said axis for urging said head towards said rest position.

17. A squeegee comprising:

a head having a forward portion, said head having a generally planar geometry and including a transversely extending internal shaft, said shaft having at least two opposed walls in generally parallel relation, a wiping blade mounted on said forward portion transversely to said head, a handle pivotally attached to said head about an axis parallel with said wiping blade, said wiping blade extending radially from and forward of said axis, said head movable about said axis between a rest position and a biased position, said head in said rest position angularly displaced relative to said handle, and with said head in said biased position said wiping blade, said head, and said handle are generally disposed in linear relation, and a spring generally contained within said head, said spring having a U-shaped forward projection extending from said axis for urging said head towards said rest position, and a tension adjustment knob rotatably disposed on said head, a linear projection extending from said tension adjustment knob into said internal shaft, and a tension adjustment nut freely disposed in said shaft and in threaded engagement with said linear projection, said tension adjustment nut having at least two generally parallel opposite edges disposed in sufficient proximity to said opposed walls of said shaft that said nut is prevented from rotating, and said U-shaped projection of said spring interposed between said tension adjustment knob and said tension adjustment nut and biased against said tension adjustment nut, such that rotation of said tension adjustment knob turns said linear projection and varies the distance between said tension adjustment knob and said tension adjustment nut for adjusting the tension of said spring.

18. A squeegee comprising:

a head having a generally planar geometry, a forward portion, a lower surface, a recess in said lower surface, and a transversely extending internal shaft, said shaft having at least two opposed walls in generally parallel relation, a wiping blade mounted on said forward portion transversely to said head, a pivot pin, a handle pivotally attached to said head about said pivot pin forming an axis parallel with said wiping blade, said wiping blade extending radially from and forward of said axis, said handle having a forward-facing surface, said head movable about said axis relative to said handle between a rest position and a biased position, said head in said rest position angularly displaced relative to said handle, and when said head is in said biased position said wiping blade, said head and said handle are in general linear relation, a spring having at least two coils and a forward projection extending from said axis, said pivot pin disposed in said at least two coils, and said spring generally contained within said head for urging said head towards said rest position, a lever pivotally attached to said head in said recess about an axis perpendicular to said head, said lever having a bottom edge in generally flush disposition with said lower surface of said head, said lever movable between a locking position and an unlocked position, in said locking position said lever in compressed abutment with said forward-facing surface for holding said head in said biased position, and in said unlocked position said lever angularly displaced from said locking position and disengaged from said forward-facing surface, and a tension adjustment knob rotatably disposed on said head, a linear projection extending from said tension adjustment knob into said internal shaft, and a tension adjustment nut freely disposed in said shaft and in threaded engagement with said linear projection, said tension adjustment nut having at least two generally parallel opposite edges disposed in sufficient proximity to said opposed walls of said shaft that said nut is prevented from rotating, and said forward projection of said spring interposed between said tension adjustment knob and said tension adjustment nut and biased against said tension adjustment nut, such that rotation of said tension adjustment knob turns said linear projection and varies the distance between said tension adjustment knob and said tension adjustment nut for adjusting the tension of said spring.

* * * * *